United States Patent [19]

Slupski

[11] Patent Number: 4,907,954

[45] Date of Patent: Mar. 13, 1990

[54] MULTIPLE LOBED PISTON PUMP WITH ANGULARLY AND AXIALLY DISPLACED SEGMENTS AND THROTTLE VALVE

[75] Inventor: Stanislaw Slupski, Winnipeg, Canada

[73] Assignee: Tomasz Slupski, Winnipeg, Canada

[21] Appl. No.: 123,546

[22] Filed: Nov. 20, 1987

[51] Int. Cl.[4] ..... F04C 18/18; F04C 23/00; F04C 29/08

[52] U.S. Cl. ..... 418/200; 418/206

[58] Field of Search ..... 418/159, 180, 200, 205, 418/206, 270; 417/286, 287, 426, 441

[56] References Cited

U.S. PATENT DOCUMENTS

| | | | |
|---|---|---|---|
| 693,609 | 2/1902 | Kirkwood | 418/200 |
| 2,028,414 | 1/1936 | Schneider | 418/200 |
| 2,382,042 | 8/1945 | Etnyre | 418/200 |
| 2,448,901 | 9/1948 | McCulloch et al. | 418/206 |
| 3,272,140 | 9/1966 | Curry et al. | 418/200 |
| 3,723,031 | 3/1973 | Brown | 418/159 |

FOREIGN PATENT DOCUMENTS

| | | | |
|---|---|---|---|
| 629654 | 5/1936 | Fed. Rep. of Germany | 418/200 |
| 633818 | 12/1949 | United Kingdom . | |

*Primary Examiner*—John J. Vrablik
*Attorney, Agent, or Firm*—Robert W. B. Bailey

[57] ABSTRACT

This relates to a novel design for lobed pistons for rotary positive displacement pumps. By segmenting the pistons and allowing the pistons segments to cooperate as independent pumps, the present noise and vibration produced by these pumps can be reduced in intensity and smeared in time. The pistons are segmented by rotating one segment with respect to another so that the lobes have angular rotational displacement. The best angular displacements are 45 degrees for two lobed pistons and 30 degrees for threes lobed pistons. As the pistons contrarotate in the pump the angular displacement must be opposite in sense, to allow segment cooperation. Allowing the segmented compression chambers to interact at the outlet, and providing a throttle valve between segments further reduces noise and vibration, giving a far smoother discharge flow and reduced pressure fluctuation. In another embodiment throttle valves are placed at the end of a conventional pistion to reduce noise and even discharge flow.

12 Claims, 11 Drawing Sheets

Fc/Fm x 100%
136.5
PERCENT
106.5
91.5
65
41.5
50°
67.5
112.5
157.5
202.5
247.5
292.5
ANGULAR ROTATION
28
27
26
0°
90°
180°
270°
20°30'
2/3 D
φD

MULTIPLE LOBED PISTON PUMP WITH ANGULARLY AND AXIALLY DISPLACED SEGMENTS AND THROTTLE VALVE

This invention relates to rotary positive displacement pumps.

More particularly it relates to improved rotary positive displacement pumps.

This type of pump is widely used in agriculture, mining, and various other industries, such as the metallurgical industry, and the paper industry. These pumps are noisy, because they operate in burst fashion, of fluid discharge followed by slack, or even suckback. This generates puressure waves or pulses in the fluid every discharge. As there are four or six such pressure waves per revolution in the two common types of pump, these devices generate a substantial amount of noise, and/or vibration. This is partly due to the nature of the pump operation, and partly due to the cycloidal profiles of the lobed pistons, which results in pressure fluctuations in parts of the cycle.

A current method of dealing with this problem is to use several stages of pumps, thus reducing the noise or vibration output per pump. Another method is to use flexible silencers between pipeline segments, when a pipe line is involved.

DESCRIPTION OF PRIOR ART

Rotary positive displacement pumps comprise a body having two contrarotating pistons, which form two or more successive chambers. The body of the pump forms two overlapping cylnders with the inlet and outlet means at opposed overlaps, traditionally these subtend substantially the same semiangle to each piston axis, the outlet and inlet may extend to a 90 degree angle to a line joining the piston axes that is the pump consists of two semicylinders with overlapping pistons and opposed inlet and outlet means between the semicylinders. There are two common versions of piston, two lobed and three lobed. The two lobes are at 180 degrees to each other, the three lobed at 120 degrees to each other. The pumps work as follows—a chamber between two successive lobes passes the inlet sucking in fluid, usually air as it goes, it is then sealed by the pump wall and rotates to the outlet. At the outlet this chamber and part of a chamber of the other piston interact to compress and expel the fluid through the outlet. The contrarotating piston lobes form an airtight lock between inlet and outlet, so that no fluid is returned from outlet to the inlet. The pistons are lobed in such a way that there is continuous contact between the two pistons at all times.

It is an object of this invention to reduce the pulsating nature of the pump discharge. This would reduce the vibration and noise output of the pumps. The noise, which is almost entirely caused by the nature of the pump and the style of piston, is an effective restraint on pump size and use.

Thus reducing noise and vibration output would enable the use of larger pumps, at higher pressures, and/or higher revolutions, and would thus increase the effective use of this type or pump.

DESCRIPTION OF THE INVENTION

In a broad aspect the invention is a multiple lobed piston adapted for use in a rotary positive displacement pump having two multiple lobed contrarotating cooperating pistons having axes of rotation, the piston having segments, the segments having angularly displaced from each other by an angular rotation less than the angular displacement between successive lobes of the piston. The multiple lobed piston may have its segments separated by circular disc means perpendicular to the axis of rotation of the piston. In general the piston will have two or three lobes, more lobes are possible but pump capacity and efficiency tend to decline with the number of lobes. The angular segment rotation is not critical it can be from small to the next successive lobe. This rotation can be 0 to 180 degrees in the two lobe case and 0 to 120 degrees in the three lobe case, if the rotation is measured in one sense. If the maximum displacement from the nearest lobe is used, or the sense is ignored, then the range is 0 to 90 degrees for the two lobe case and 0 to 60 degrees for the three lobe case. When the angular segment rotation is halfway between successive lobes, the non cooperating segments of two segment pistons tend to reinforce each others' effect. The quarterway way rotation of 45 degrees in the two lobe case and 30 degrees in the three lobe case, produces pulses midway between those of other segments of the same pistons. This would produce the most desirable effect, of spreading the pulses most evenly, however nearly all angular rotations would produce the desired effect of more pulses, and less vibration and noise.

In a pair of cooperating pistons, cooperating segments must have substantially equal but opposite rotations, as the pistons and their segments rotate in opposite senses, the rotations must be opposite, and to cooperate be of substantially equal magnitude. If one segment leads by an angle, the cooperating segment must also lead by substantially the same angle, if it lags then the other segment must also lag by substantially the same angle.

In another aspect the invention is an improvement in a rotary positive displacement pump having two multiple lobed contrarotating cooperating pistons having axes of rotation, the improvement comprising each piston having segments, the segments being angularly displaced from each other by an angular rotation less than the angular displacement between successive lobes of the piston, respective cooperating segments of each piston being displaced substantially identical angular rotations in opposite senses, whereby each segment cooperates with the respective cooperating segment of the other piston. In preferred form each piston rotates in a partially cylindrical body, ring sector means project inward from the partially cylindrical wall, to contact the piston between the segments of the piston, whereby the respective cooperating segments of the pistons act as substantially independent pumps. The ring sector may extend across the entire pump interior to the piston spindle, or it may start and stop at inlet and outlet means, or even be more restricted. In more preferred form the ring sector means contacts circular disc means projecting from the piston between segments. The circular disc can be non existent, but its maximum radius is half the distance between the piston axes. The function of both circular disc means and ring sector means is to keep the segment compression chambers distinct. The ring sector means may include throttle valve means.

In another preferred embodiment, the invention may be a rotary positive displacement pump having two multiple lobed contrarotating cooperating pistons having axes of rotation, and inlet means and outlet means substantially parallel to the rotation axes, the pistons comprising segments, the segments being angularly displaced from each other by an angular rotation less than the angular displacement between successive lobes of the piston, respective cooperating segments of each piston being displaced substantially identical angular rotations in opposite senses, whereby each segment cooperates with the respective cooperating segment of the other piston, each cooperating piston rotating in a partially cylindrical body, ring sector means projecting inward from the partially cylindrical wall, and contacting the piston between the segments of the piston, whereby the respective cooperating segments of the pistons act as substantially independent pump chambers, throttle valve means in the ring sector means extending along the cylindrical body from the outlet towards the inlet means.

Preferably the throttle valves extends to a point more than the angular distance between successive piston lobes from the inlet means, this prevents contact between pump chambers in sucking mode to the throttle valve, and thus to the pump chambers in compression mode. As the lobes occupy space the throttle valve can actually extend under the piston lobe, as long as the valve does not contact pump chambers in suction mode. The throttle valves are preferably paired, one for each piston. The throttle valve can be used to connect all the pump chambers in neutral or compression mode to the outlet means.

The throttle valve in preferred form is a channel means in the ring sector having connecting apertures to the pump chambers. In more preferred form the channel means has an inner circumferential wall parallel to the piston axes and paired spaced apart opposed apertured walls connecting the inner wall to an outer circumferential wall abutting the cylindrical body. The throttle valve may be adjustable using a controlling screw. Adjustment is performed during the pumping to minimize noise and vibration. The throttle valve enables more continuous even discharge from chambers under compression.

The outlet and inlet means are slots extending substantially the length of the pistons, these can extend laterally until the angular distance between inlet and outlet is 180 degrees, The effective semiangle of the outlet and inlet would be 42 degrees, using two lobe pistons or 48.5 degrees using three lobe pistons.

A convenient semiangle would be about 19 degrees 30 minutes for the two lobe case and 18 degrees 30 minutes for the three lobe case. In the matter of semiangles it must be remembered that there is a compromise between capacity use, pressures, rpm and the like, and as would be realized by those skilled in the art, appreciable variation is possible. The size of rotary pumps of this nature currently range from 2 cms to 1 meter, and consequently there are no absolute semiangles, which can be rigidly applied.

In another broad aspect the invention is an improvement in a rotary positive displacement pump having two multiple lobed contrarotating cooperating pistons having axes of rotation, each cooperating piston rotating in a partially cylindrical body, inlet means and outlet means substantially parallel to the rotation axes, the improvement comprising at least one throttle valve means extending along the cylidrical body from the outlet means towards the inlet means, in a plane perpendicular to the axis of rotation of each piston, the throttle valve means abutting the piston, wherein the throttle valve means extend to a point more than the angular distance between successive piston lobes from the inlet means. This enables the throttle valve to assist in evacuating the chambers in compression mode. While the best approach would be to have four throttle valves, valves being present at each end of each piston, a valve at one end of each piston would improve flow. This would be expected to have less effect than using both valves and segmented pistons, but could be achieved with less change to pump design.

In general, the outlet width is substantially the same as the inlet width, the outlet width can be larger than the inlet, up to 6 to 12 mm wider, 3 to 6 mm each side.

In the normal range of tolerance, 0.2 mm is satisfactory with this equipment, finer being required for smaller versions, greater being acceptable for larger versions.

DESCRIPTION OF PREFERRED EMBODIMENTS

Preferred embodiments are described as indicated in the drawings, where:

FIG. 3 is a detail of a preferred throttle valve of the invention.

The term $\phi$D in some of the insets means that the curves represent (parts of) circles.

Figure 1:
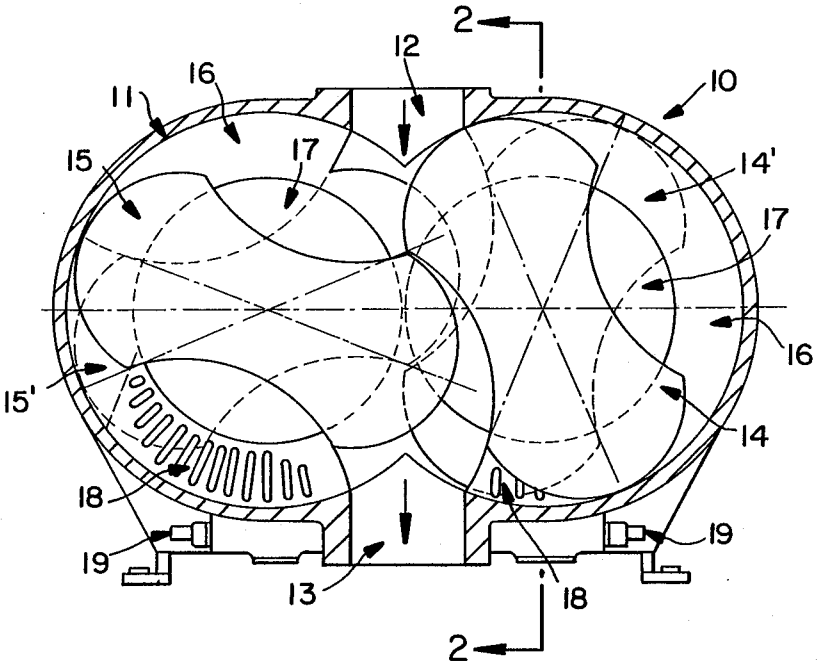
FIG. 1 is a transverse cross section of both chambers of an embodiment of the invention.
Figure 2:
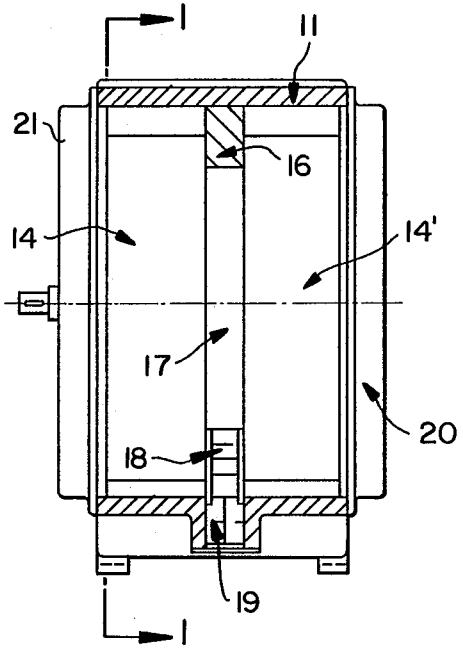
FIG. 2 is an axial cross section of a segmented piston in a chamber of an embodiment of the invention.
Figure 3B:
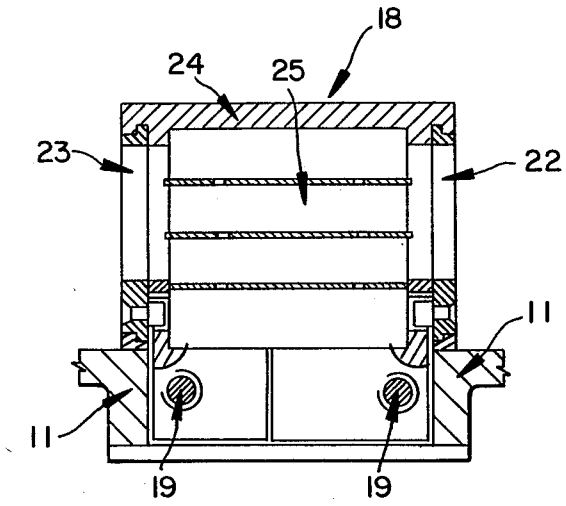
FIG. 3*b* shows the throttle valve in exit cross section.
Figure 3A:
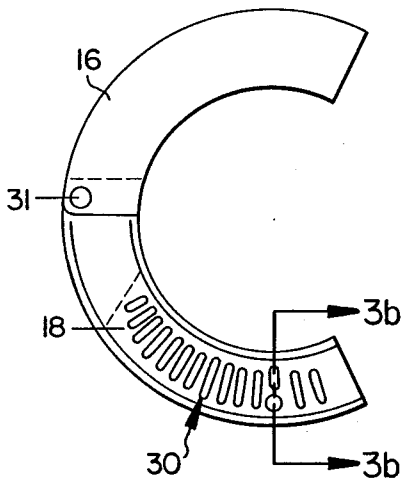
FIG. 3*a* shows the throttle valve in plan.

Referring to the drawings in FIGS. 1 and 2, the rotary positive displacement pump is generally indicated by the numeral 10 having body 11 forming a surrounding wall, having inlet port 12 and outlet port 13, and interacting contrarotating pistons having upper piston segments 14 and 15, upper segment 14 rotates clockwise, while upper segment 15 rotates counterclockwise. Lower piston segments are indicated by broken lines, lower segment 14' leads upper segment 14 by 45 degrees, lower segment 15' leads upper segment 15 by 45 degrees, as the pistons rotate in opposite senses the displacements are in opposite directions. The segments of each piston are separated by ring members 16 projecting from body 11 forming shelves between inlet port 12 and outlet port 13, and projections 17 from the pistons, which form circular discs. In this case the outlet part of the rings form throttle valves 18 adjustable by control screws 19. The screws 19 upon rotation move toward or away from outlet 13, as these screws pass through the throttle valve 18, nested within exterior wall 11 as shown in FIG. 3*b*, they move the throttle valve itself with the screw movement toward or away from outlet 13 thus adjusting the position of the throttle valve with respect to the outlet. The pump is completed by ends or sides 20 and 21, side 21 contains conventional drive bearings (not shown) for pistons 14 and 15, side 20 contains conventional idler bearings (not shown) for pistons 14 and 15. FIG. 3 shows details of the throttle valve 18, including an expanded view of the valve outlet shown in FIG. 2. FIG. 3*a* shows ring member 16, and conforming member 18 forming the throttle valve, the array of apertures is indicated in the figure, FIG. 3*b* shows an enlarged cross section of the throttle valve 18 it has apertured bottom wall 22, and apertures top wall 23, connected by inner bearing wall 24, forming channel 25, inner bearing wall 24 and circular disc 17 (not shown) form an effective sliding seal when the pump is assembled.

"In FIGS. 1 to 3, channel 25 can only be seen in FIGS. 2 and 3*b* as it necessarily lies entirely within throttle valve 18, when viewed axially as in FIGS. 1 and 3*a*. Channel 25 communicates with outlet 13 at the end of throttle valve 18 adjacent outlet 13, channel 25 and the effective portion of throttle valve 18 terminate at broken line 29. As shown in FIG. 1, the throttle valve 18 terminates at the edge of body wall at the edge of outlet 13. Cross sectional views of channel 25 are indicated in FIGS. 2 and 3*b*. Throttle valves 18 have apertures 30, to allow fluid pushed by piston segments to enter the valves from the effective compression chambers formed between piston segments 14 and 15 and outlet 13."'Throttle valves 18 may be integrally formed within rings 16, in which case they are not adjustable. Throttle valves 18 in one sense act as rings 16, as they form a barrier between piston segments. Preferably as in FIG. 3*a*, they are separate and hinged by pin 31. This allows relative movement of the throttle valve 18, with respect to hinge pin 31, and thus ring 16, such movement allows minor adjustment of the position of the throttle valve at installation or assembly of the pump, it similarly allows disassembly. The throttle valves do not interact directly with each other as they discharge independently into the outlet."

Figure 4A:
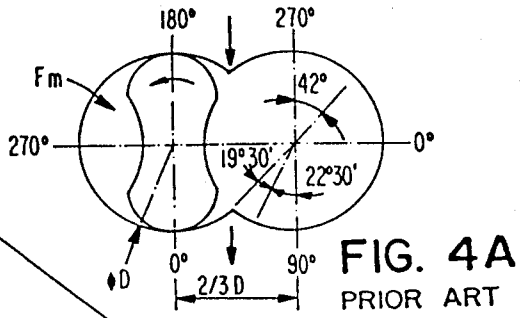
FIG. 4A PRIOR ART
FIG. 4 is a diagram of utilized capacity during operation of a theoretical prior art pump, with FIG. 4A indicating the pump operation.
Figure 4:
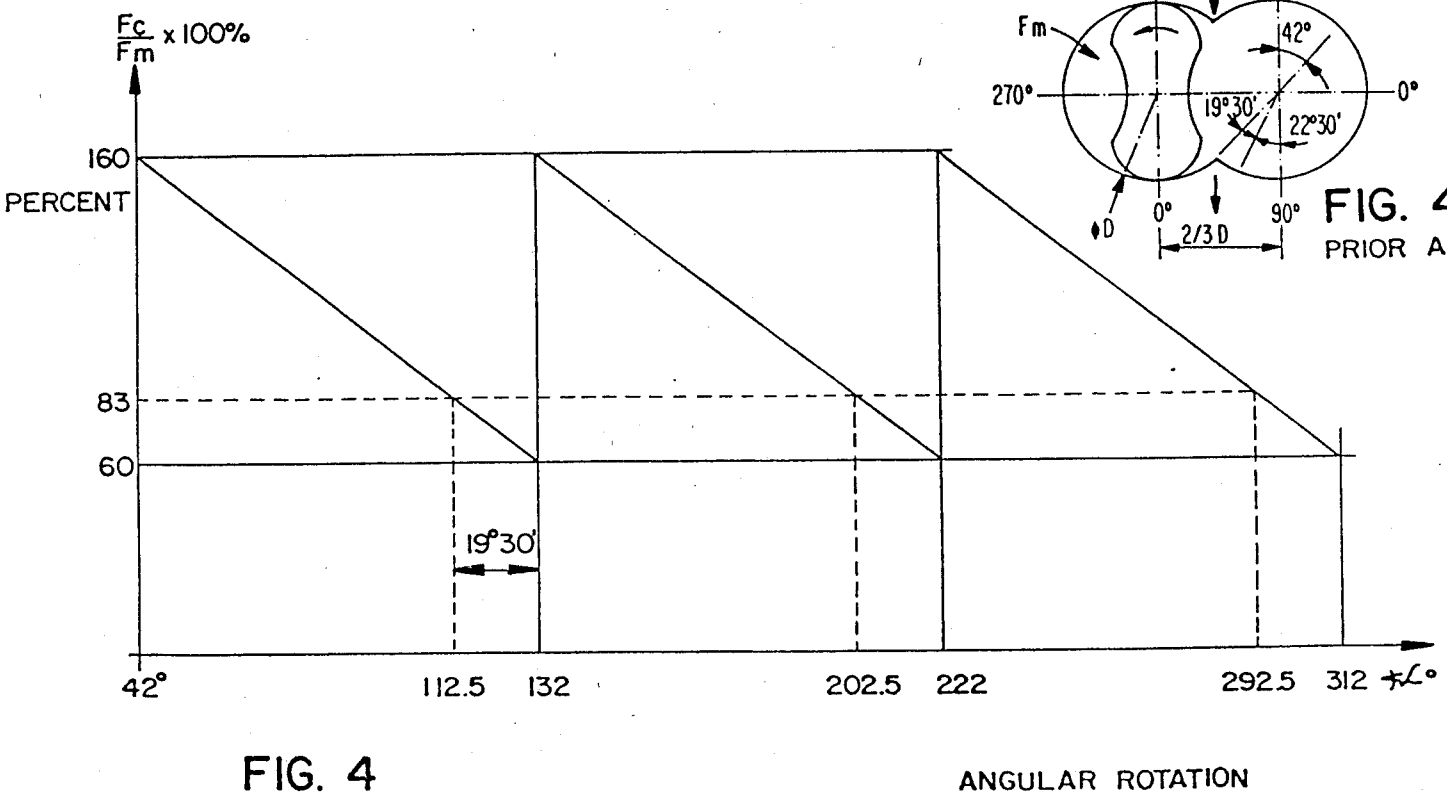
FIG. 4 PRIOR ART

FIG. 4 shows operation of a theoretical prior art pump having inlet and outlet ports of zero dimension. The graph illustrates the utilized actual capacity (Fc), in contact with the outlet port at any one time, of a prior art compression chamber in term of the maximum capacity (Fm) of one side of a single piston with respect to angular rotation of the lefthand piston in FIG. 4A, where the angular rotation from 0 degrees is indicated, the lefthand piston rotates counterclockwise, the righthand piston clockwise. As the lefthand piston reaches 42 degrees it begins to reduce the utilized capacity of the discharging side of the piston, which continues until 132 degrees when it has discharged as much as possible, and a new intake (Fm) is now sealed into the compression chamber. The cycle repeates itself four times during a rotation, of which three are shown. The broken lines indicate the positions of real outlet ports on the theoretical graph.

Figures 5, 5A:
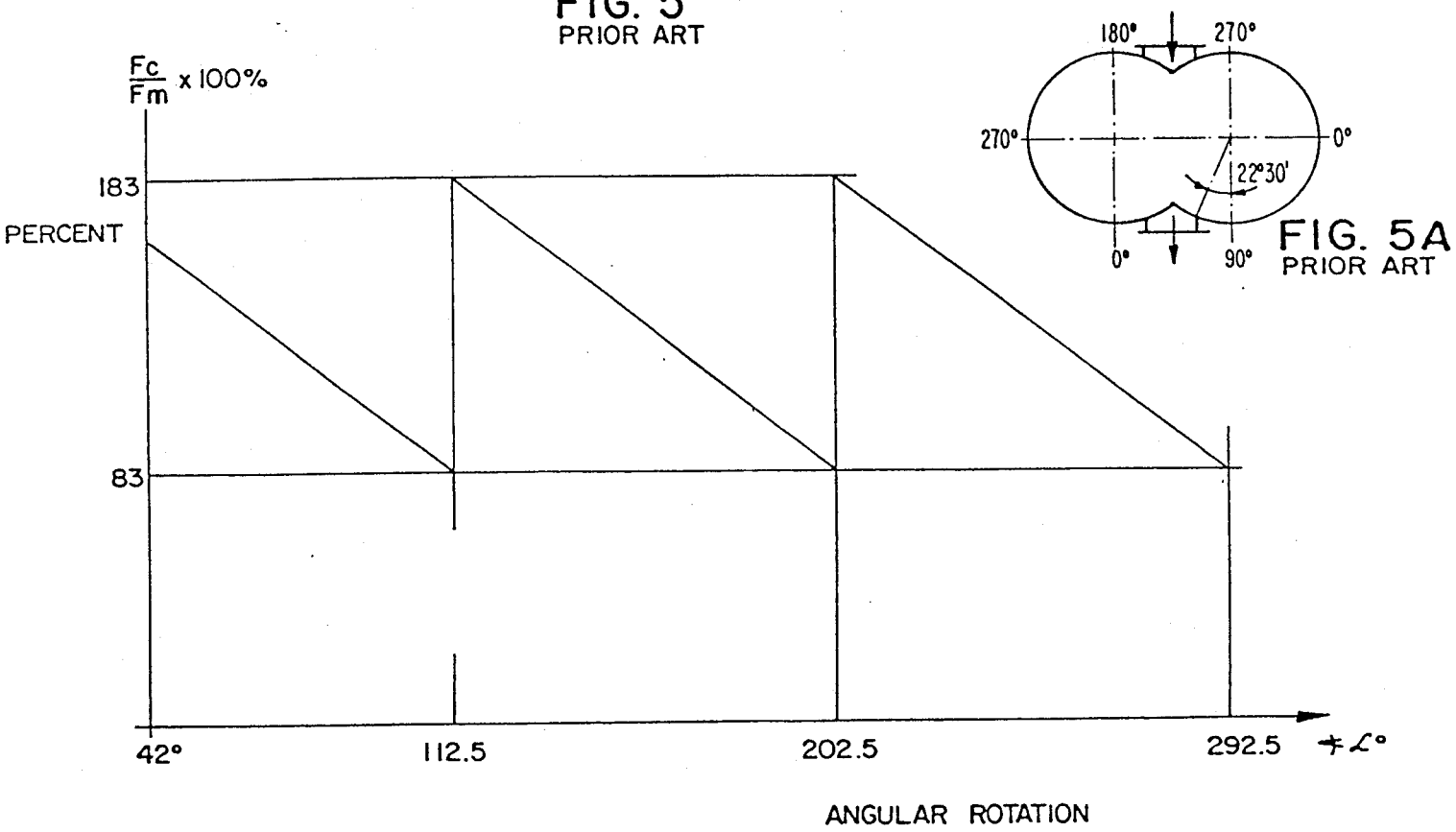
FIG. 5A PRIOR ART
FIG. 5 PRIOR ART
FIG. 5 is a diagram of utilized capacity during operation of a real prior art pump, with FIG. 5A indicating the pump operation.

FIG. 5, demonstrates the real utilization of capacity of the prior art system when real outlet ports having a semiangle of 19 degrees 30 minutes, are present again four cycles occur in a rotation. As indicated in FIG. 5A, the compression chamber contacts the outlet at 19 degrees 30 minutes. The minimum utilized capacity of the compression chamber is increased as is the maximum utilized capacity.

Figure 6:
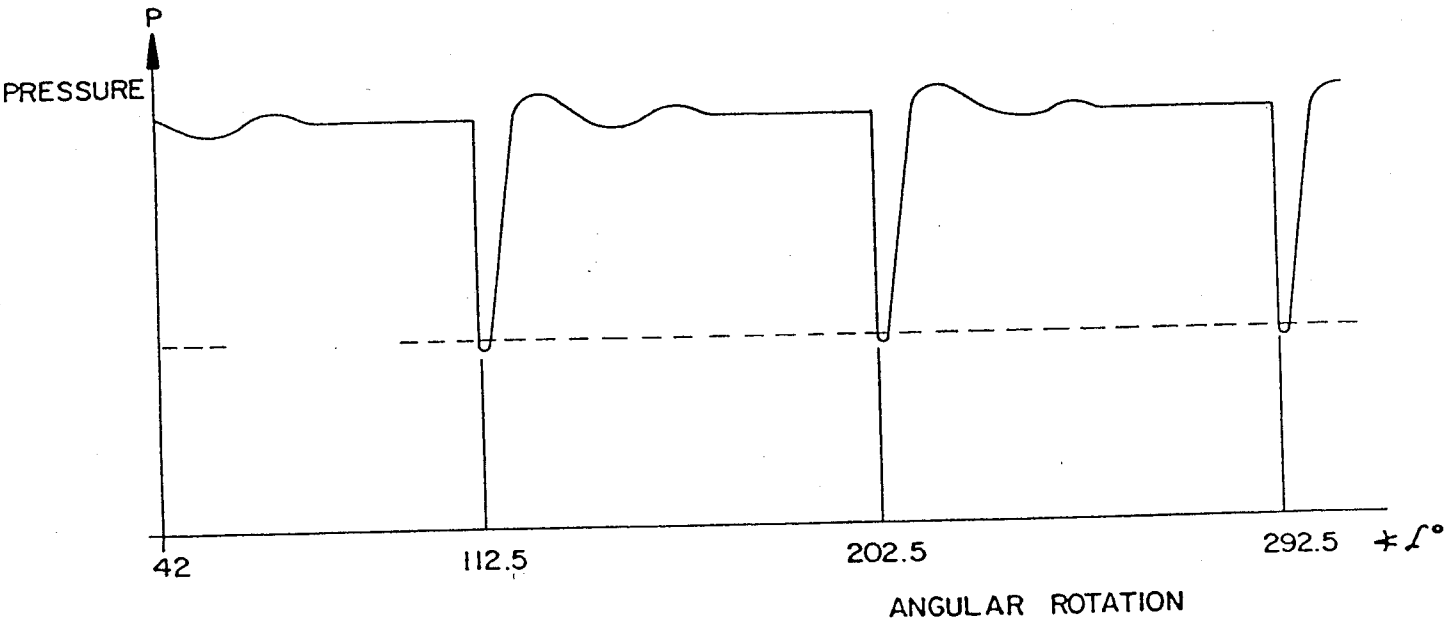
FIG. 6 PRIOR ART
FIG. 6 is a diagram of forcing pressure during operation of a real prior art pump.

FIG. 6 shows the forcing pressure during the prior art cycle as the pistons rotate, the connecting of the new discharge space at 112 degrees 30 minutes, 202 degrees 30 minutes, 292 degrees 30 minutes and also (not shown) 22 degrees 30 minutes, results in a slight suck back effect and thus a reduction of pressure below atmospheric (ambient) pressure.

Figures 7, 7A:
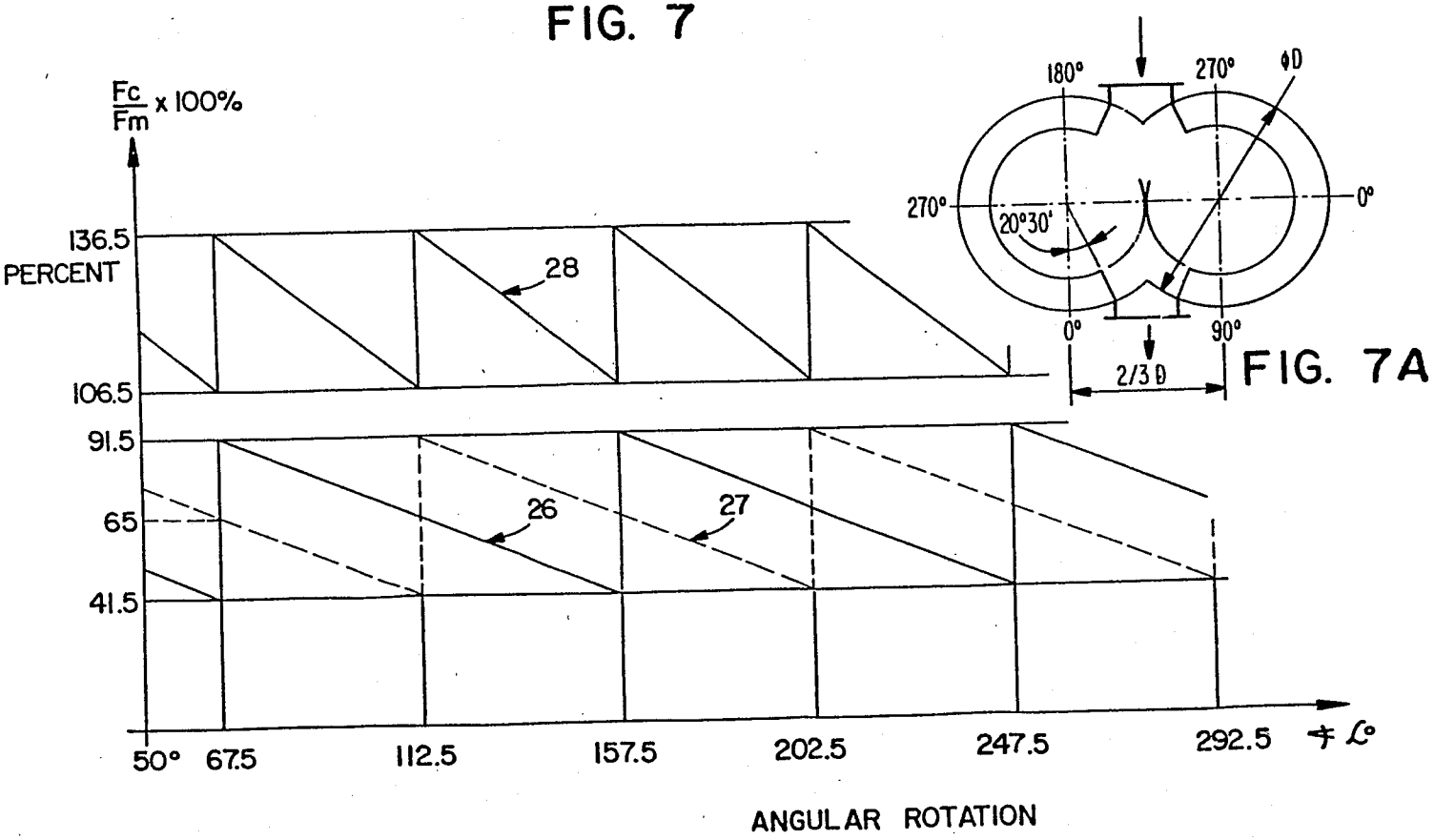
FIG. 7 is a diagram of utilized capacity during operation of an embodiment of the invention, with FIG. 7A indicating the pump operation.

FIG. 7 shows the real utilization of capacity of the present invention, where interacting pairs of piston segments operate as two separate compression systems, and each piston segment is taken as having 0.5 Fm. Lower graph broken line 27 shows the capacity utilization as half that shown in FIG. 6, since this pair of segments operate the same cycle with half capacity. Lower graph solid line 26 shows the capacity utilization of a pair of piston segments offset by a rotation of 45 degrees from the pistons of line 27. The upper line 28 shows the combined capacities of both halves of the pump, when these halves act independently. FIG. 7A shows the ring sector between inlet and outlet, and a possible extension across the outlet. This method has up to four piston segments (each 0.5 Fm) acting in contact with the outlet port at a given time.

Figure 8:
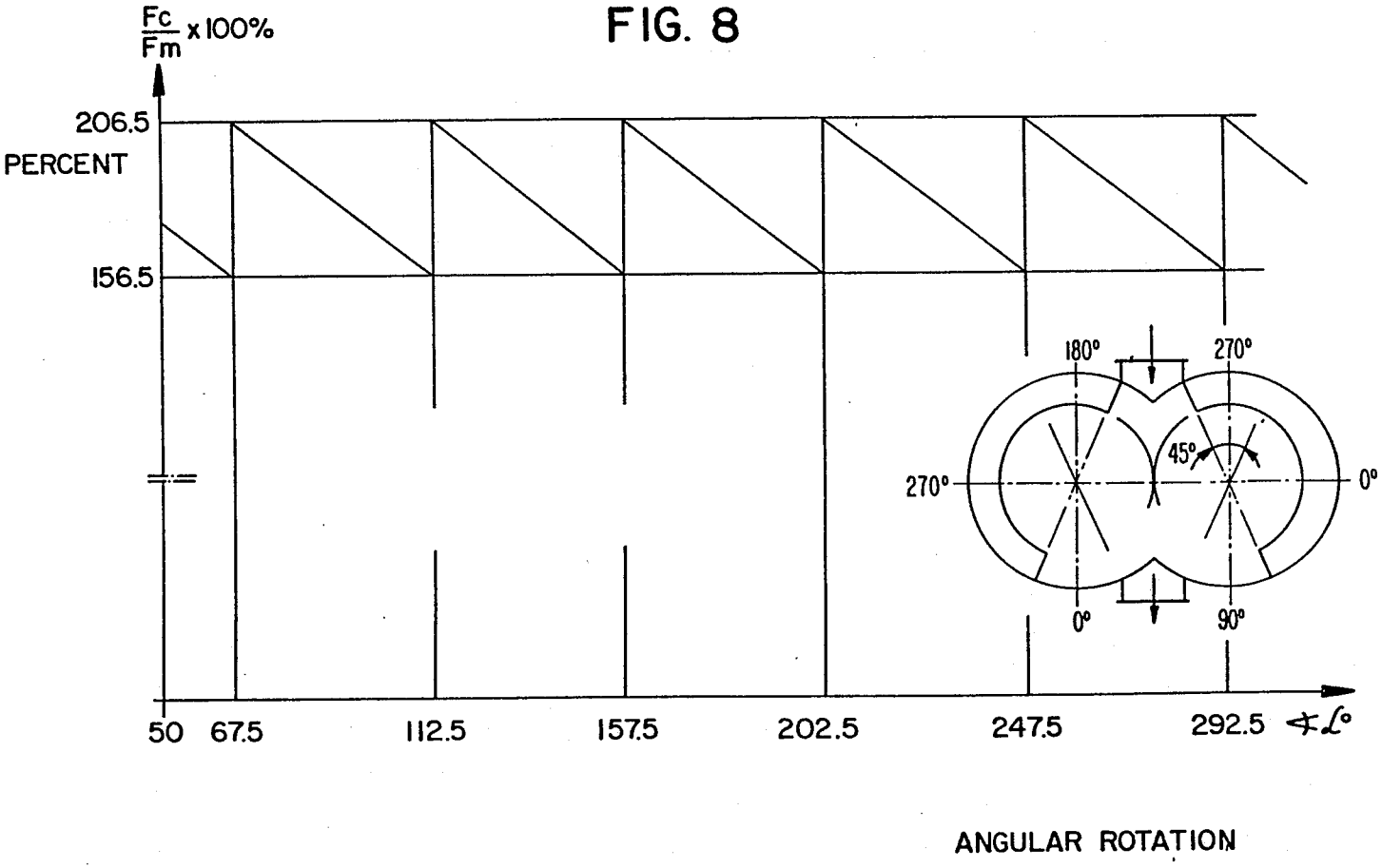
FIG. 8 is a diagram of utilized capacity during operation of an embodiment of the invention, with an inset indicating the pump operation.

FIG. 8 shows the real utilization of the capacity of the present invention when the halves of the pump are allowed to interact 45 degrees before the lagging segment contacts the outlet edge. In effect this adds an extra piston segment to utilization capacity, thus instead of parts of four piston segments, parts of five piston segments can be in contact wit the outlet. This contact occurs as the other end of the piston segment passes the edge of the inlet. The inset indicates the absence of the ring sector in this 45 degree sector extending from the outlet towards the inlet.

Figure 9:
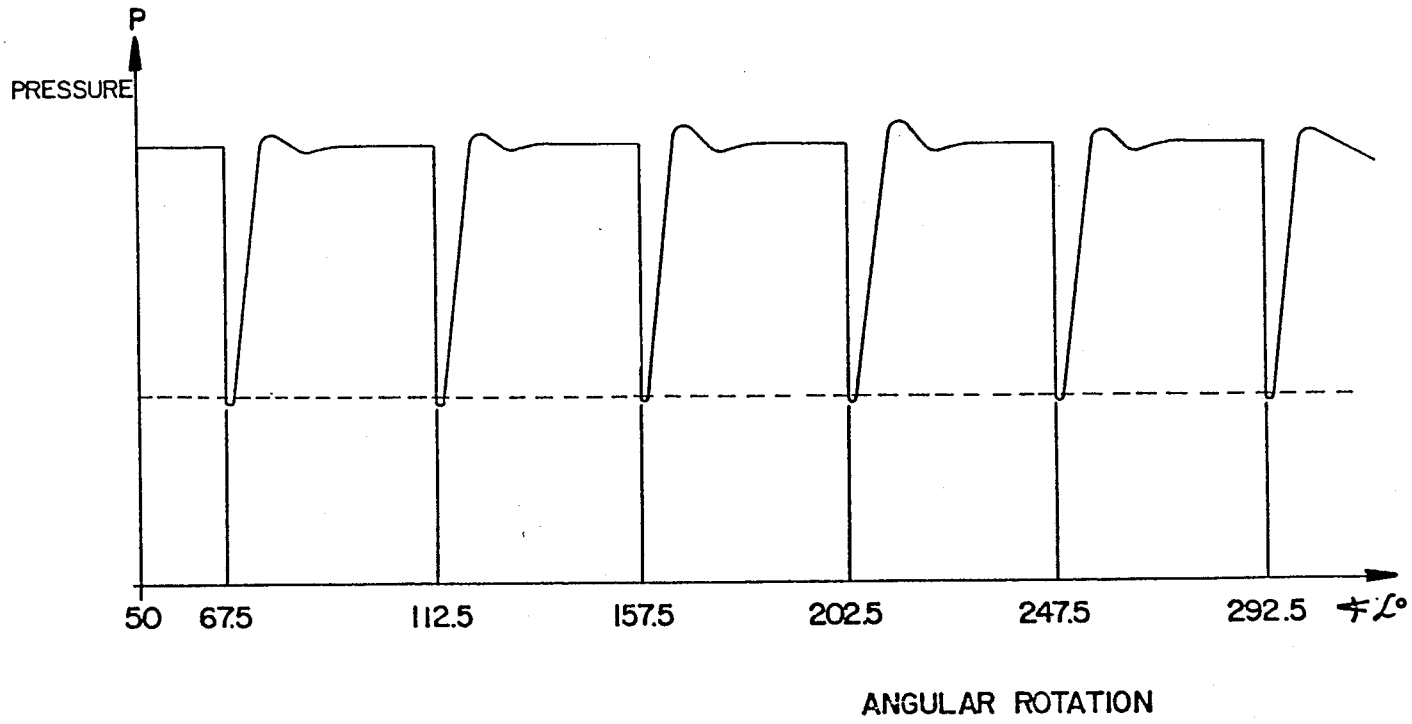
FIG. 9 is a diagram of forcing pressure during operation of the embodiment of FIG. 9.

FIG. 9 shows forcing pressure produced by the utilization of capacity in FIG. 8, this has eight cycles a rotation.

Figures 10, 10A:
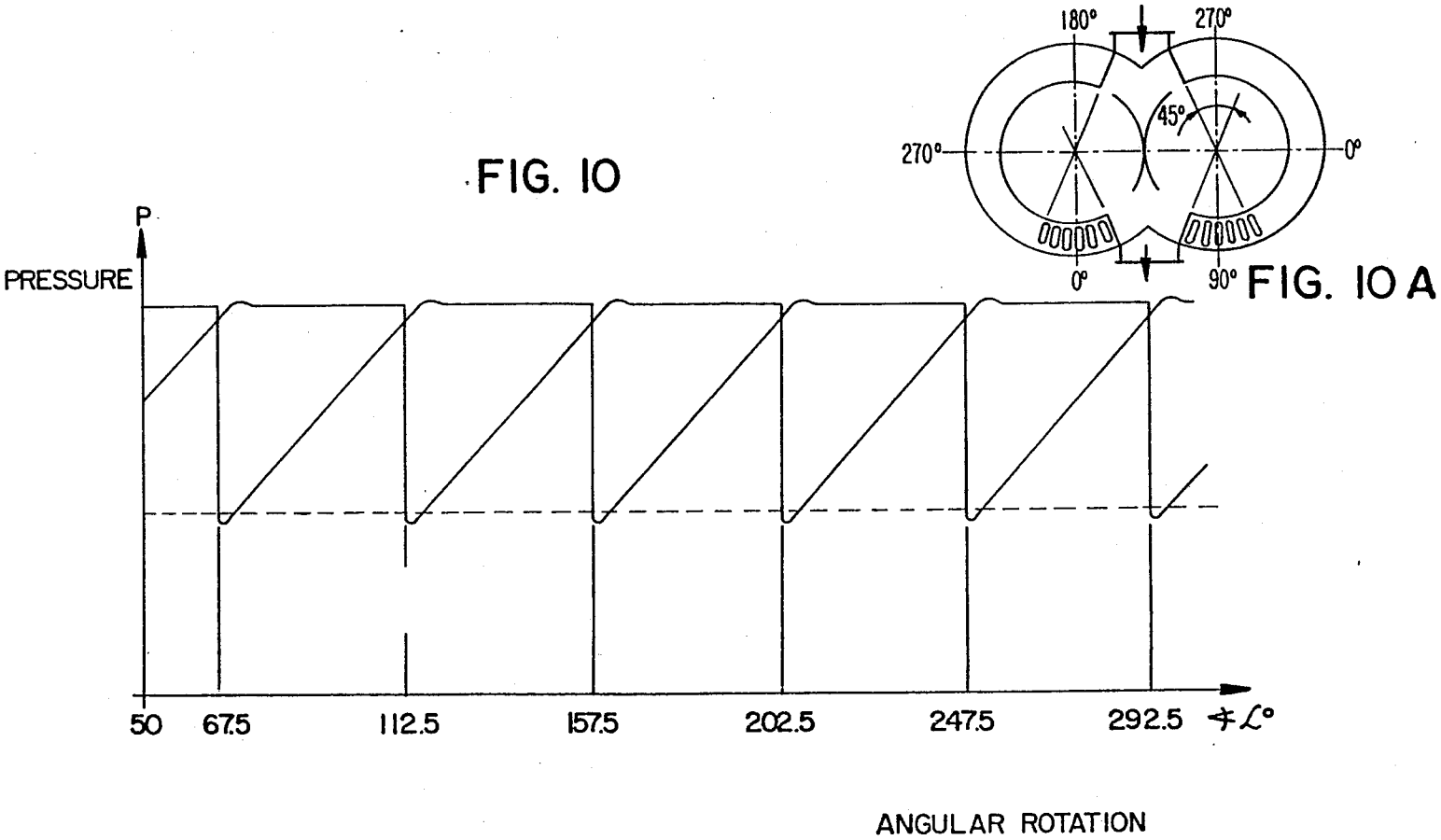
FIG. 10 is a diagram of forcing pressure during operation of an embodiment of the invention lindicated in FIG. 10A.

FIG. 10 shows forcing pressure when a throttle valve is put into the 45 degrees before the outlet smoothing the pressure fluctuation, this arrangement is generally indicated in FIG. 10A, wherein the throttle valves filling the 45 degree gaps are illustrated.

Figure 11:
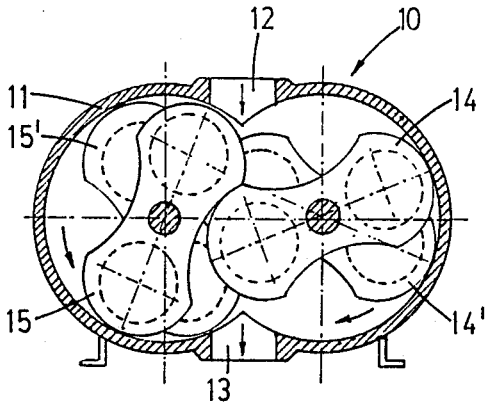
FIG. 11 shows an axial view of a two lobe piston pump arrangement, as utilised in the invention.
Figure 12:
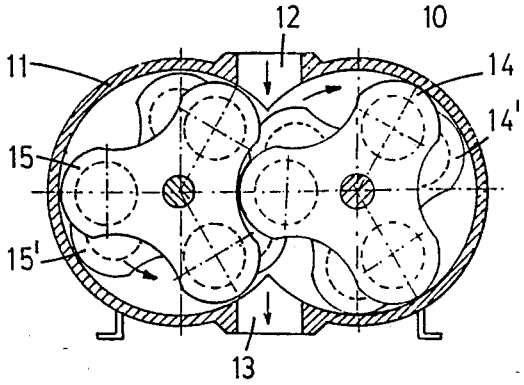
FIG. 12 shows an axial view of a three lobe piston pump arrangement, as utilised in the invention.

FIGS. 11 and 12 show the cooperation of paired pistons of this invention as utilised in the rotary pumps, the ring members 16 and throttle valves 18 have been omitted from the drawing (but not the pumps) for clarity. Upper piston segments 14 and 15 cooperate with each other as do displaced lower segments 14' and 15', the two lobed arrangement is shown in FIG. 11, the three lobed in FIG. 12.

Figure 13:
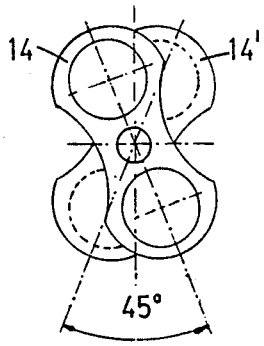
FIG. 13 shows an axial view of a two lobe piston, as utilised in the invention.
Figure 14:
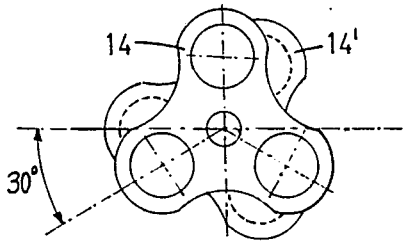
FIG. 14 shows an axial view of a three lobe piston, as utilised in the invention.

FIGS. 13 and 14 show individual pistons, FIG. 13 having upper segment 14 of the two lobe piston displaced by 45 degrees from the lower segment 14', while FIG. 14 has upper segment 14 of the three lobe piston displaced by 30 degrees from the lower segment 14'.

Figure 15:
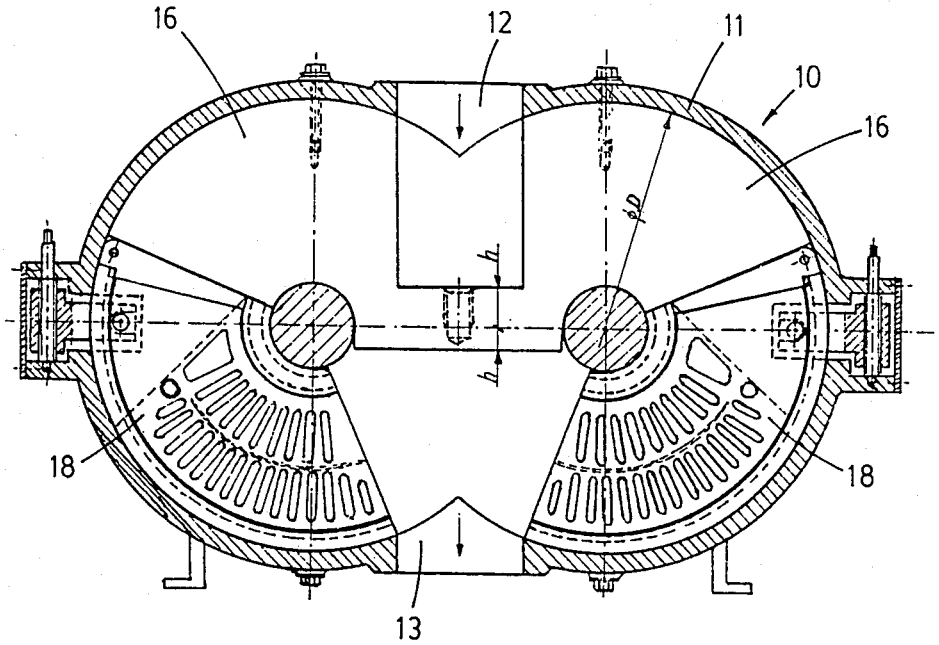
FIG. 15 shows an axial view of a throttle valve arrangement, as utilised in the invention with a two lobe piston.
Figure 16:
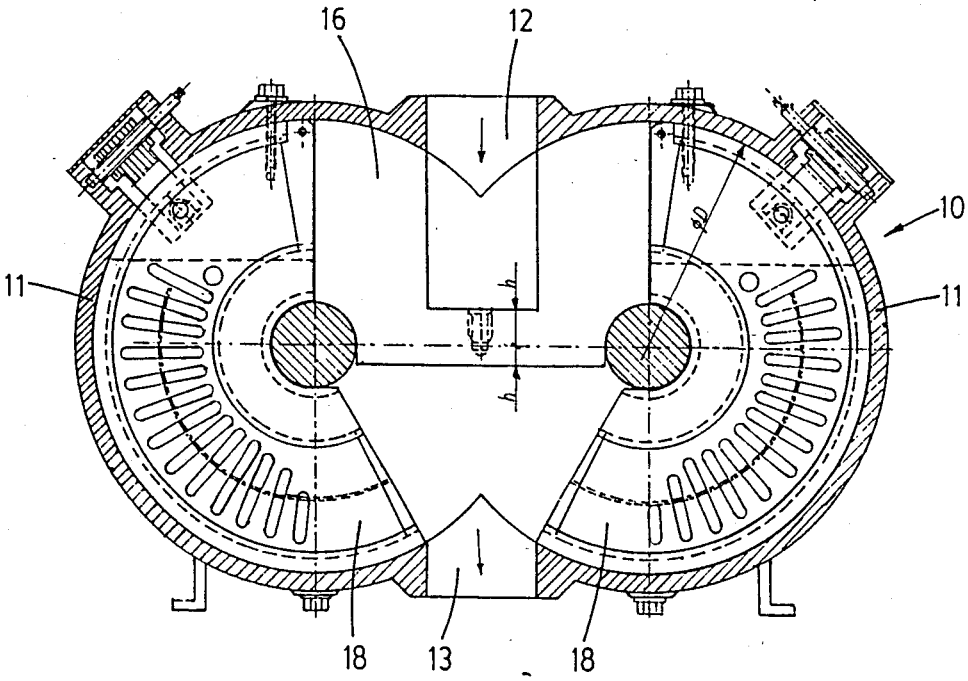
FIG. 16 shows an axial view of a throttle valve arrangement, as utilised in the invention with three lobe piston.

FIGS. 15 and 16 show axial views of throttle valve arrangements. In FIGS. 15 and 16, throttle valves 18 extend from outlet 13 along cylindrical wall 11 of pump 10, toward inlet 12, the portion of wall 11 not covered by throttle valves 18, is covered by ring member 16, which extends to inlet 12. In FIG. 15, throttle valves 18 are adapted for use with the two lobe piston form and extend a lesser angular distance from outlet 13, than they extend in FIG. 16, adapted for use with the three lobe piston. The throttle valves extend slightly closer toward inlet 12, than would be expected. This is acceptable because as can be seen in FIG. 1, the pistons have sufficient dimension to allow the throttle valve to extend closer to the inlet than the theoretical 120 or 180 degree angle.

In operation in the prior art, the lefthand piston lobe sucks in Fm capacity until the piston lobe trailing edge passes 157 degrees 30 minutes, this capacity is maintained sealed until the lobe leading edge passes 22 degrees 30 minutes (the trailing edge is at 202 degrees 30 minutes), whereupon dischare begins in theory, in practice discharge begins later.

In the embodiment with the cycles shown in FIG. 7 the lower segments of the pistons are advanced 45 degrees, this effectively gives 8 pulses a revolution, rather than 4, which would be expected to reduce the noise level, although increasing the frequency. This is not the most effective way of doing so. In FIG. 8 the lagging segment of the piston forms a compression chamber which comes in contact with the compression chamber of the leading segment of the piston, at an angle 45 degrees before the outlet edge. This evens the pressure flow to some extent. If this 45 degree gap is filled with a throttle valve between segments of the piston, then the discharge of compression chambers becomes more even, the flow is possible along the throttle valve and not just the through the outlet. The three compression chambers interact with each other through the throttle valve to produce the much more even flow shown in FIG. 10.

Each step, piston segmentation, chamber interaction and throttle valve, tend to even output pressure or increase pulse frequency, this tends in turn to reduce noise output. Reduction of noise output and vibration is desirable to improve pump efficiency.

These preferred embodiments have been described in terms of segmented two and three lobed pistons. The invention can be extended to pistons having more than three lobes, while such pistons have been proposed, they are not widely used, but the present invention could be applied thereto.

The invention encompasses multiple segmented pistons, preferred embodiments are described in terms of two and three segment pistons, pistons with more than three segments can be employed.

Although this invention is described in terms of specific embodiments, it is not limited thereto, as would be understood by those skilled in the art, numerous variations are possible within the scope of the invention, without departing from the spirit and nature thereof.

I claim:

1. In a rotary positive displacement pump having inlet and outlet means, and two multiple lobed contrarotating cooperating pistons having axes of rotation, the improvment comprising each said pistons having segments, said segments being angularly displaced from each other by an angular rotation less than the angular displacement between successive lobes of the piston, respective cooperating segments of each piston being displaced substantially identical angular rotations in opposite senses, whereby each said segment cooperates with said respective cooperating segment of the other piston, each said piston rotates in a partially cylindrical body, having a partially cylindrical wall, and ring sector means projecting inward from said partially cylindrical wall and contacting said piston between said segments of said piston, said ring sector means comprising throttle valve means.

2. The pump of claim 1, wherein said ring sector means contacts circular disc means projecting from said piston between segments.

3. A rotary positive displacement pump having two multiple lobed contrarotating cooperating pistons having axes of rotation, and inlet means and outlet means radial to said axes of rotation, substantially parallel to said rotation axes, said pistons comprising segments, said segments being angularly displaced from each other by an angular rotation less than the angular displacement between successive lobes of the piston, respective cooperating segments of each piston being displaced substantially identical angular rotations in opposite senses, whereby each said segment cooperates with said respective cooperating segment of the other piston, each said cooperating piston rotating in a partially cylindrical body, forming a partially cylindrical wall, ring sector means projecting inward from said partially cylindrical wall, and contacting said piston between said segments of said piston, throttle valve means in said ring sector means extending along said cylindrical body from said outlet towards said inlet means, said partially cylindrical bodies intersecting to form opposed junctions, said inlet and outlet means forming slots at said opposed junctions.

4. The pump of claim 3, further including paired opposed throttle valves on either side of said outlet means.

5. The pump of claim 4, wherein said throttle valves extend to a point more than the angular distance between successive piston lobes from said inlet means.

6. The pump of claim 4, wherein said throttle valve comprises channel means in said ring sector having connecting apertures to said pump chambers.

7. The pump of claim 6, wherein said channel means has an inner wall circumferential to the piston axis and paired spaced apart opposed apertured walls connecting the inner wall to an outer circumferential wall abutting said cylindrical body.

8. The pump of claim 7, wherein said throttle valve comprises an adjusting means.

9. The pump of claim 3, wherein said inlet means and outlet means are slots extending substantially the length of the pistons, subtending semiangles to the piston axes substantially between 19 degrees 30 minutes and 42 degrees.

10. The pump of claim 9, wherein said pistons are two lobed and said semiangle is substantially 19 degrees 30 minutes.

11. The pump of claim 9, wherein said pistons are three lobed and said semiangle is substantially 18 degrees 30 minutes.

12. The pump of claim 9, wherein said outlet means is about 6 to 12 mm wider than said inlet means.

* * * * *